US012215509B2

(12) United States Patent
Wiesenack et al.

(10) Patent No.: US 12,215,509 B2
(45) Date of Patent: Feb. 4, 2025

(54) METHOD FOR OPERATING A WORKING MACHINE, AND WORKING MACHINE

(71) Applicant: Putzmeister Engineering GmbH, Aichtal (DE)

(72) Inventors: Carl Wiesenack, Munich (DE); Frederik Kort, Stuttgart (DE); Stefan Hoefling, Seligenstadt (DE); Mirco Kuhlmey, Nuertingen (DE); Markus Frasch, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 470 days.

(21) Appl. No.: 17/642,605

(22) PCT Filed: Aug. 20, 2020

(86) PCT No.: PCT/EP2020/073303
§ 371 (c)(1),
(2) Date: Mar. 11, 2022

(87) PCT Pub. No.: WO2021/047872
PCT Pub. Date: Mar. 18, 2021

(65) Prior Publication Data

US 2022/0341197 A1 Oct. 27, 2022

(30) Foreign Application Priority Data

Sep. 13, 2019 (DE) ..... 10 2019 214 034.3

(51) Int. Cl.
*E04G 21/00* (2006.01)
*E04G 21/04* (2006.01)

(52) U.S. Cl.
CPC ..... *E04G 21/0463* (2013.01)

(58) Field of Classification Search
None
See application file for complete search history.

(56) References Cited

U.S. PATENT DOCUMENTS 5,742,500 A 4/1998 Irvin
6,845,336 B2 1/2005 Kodukula et al.
(Continued)

FOREIGN PATENT DOCUMENTS

CN 1571886 A 1/2005
CN 102707730 A 10/2012
(Continued)

OTHER PUBLICATIONS

Benckert WO2004020765 English Translation 2004 (Year: 2004).*
(Continued)

*Primary Examiner* — Jacob T Minskey
*Assistant Examiner* — Adrien J Bernard
(74) *Attorney, Agent, or Firm* — Crowell & Moring LLP

(57) ABSTRACT

A method is provided for operating a working machine having a device for conveying thick material. A number of target values relating to the operation of the device for conveying thick material can be adjusted by a user. The method includes the following steps: detecting a number of actual values of the device; calculating a target value optimum for a respective target value of the number of adjustable target values based on the number of detected actual values; and outputting a notification for the user, in the event that an adjusted target value of the number of adjustable target values does not correspond to its calculated target value optimum.

11 Claims, 2 Drawing Sheets

(56) References Cited

U.S. PATENT DOCUMENTS

| | | | |
|---|---|---|---|
| 6,901,560 | B1 | 5/2005 | Guerlain et al. |
| 7,322,802 | B2 | 1/2008 | Benckert et al. |
| 7,330,767 | B2 | 2/2008 | Thiele et al. |
| 7,729,832 | B2 | 6/2010 | Benckert et al. |
| 2004/0076503 | A1 | 4/2004 | Rau et al. |
| 2006/0277094 | A1 | 12/2006 | Kirsch et al. |
| 2008/0249679 | A1 | 10/2008 | Matsuda et al. |
| 2020/0385242 | A1 | 12/2020 | Heiker et al. |

FOREIGN PATENT DOCUMENTS

| | | | |
|---|---|---|---|
| CN | 102707730 | B | 9/2014 |
| DE | 101 50 467 | A1 | 4/2003 |
| DE | 600 07 750 | T2 | 1/2005 |
| DE | 10 2005 025 282 | A1 | 12/2006 |
| DE | 10 2015 208 577 | A1 | 11/2016 |
| DE | 103 62 408 | B3 | 6/2017 |
| DE | 10 2018 104 491 | A1 | 8/2019 |
| EP | 2 103 760 | A2 | 9/2009 |
| EP | 2 799 712 | A2 | 11/2014 |
| JP | 10-331426 | A | 12/1998 |
| JP | 2004-526081 | A | 8/2004 |
| JP | 2013-91931 | A | 5/2013 |
| KR | 10-2006-0118415 | A | 11/2006 |
| WO | WO 2004/020765 | A1 | 3/2004 |
| WO | WO 2019/160894 | A1 | 2/2019 |

OTHER PUBLICATIONS

Heiker DE102018104491 English Translation 2019 (Year: 2019).*

Japanese-language Office Action issued in Japanese Application No. 2022-516090 dated Feb. 6, 2024 with English translation (5 pages).

Chinese-language Office Action issued in Chinese Application No. 202080063838.9 dated Apr. 15, 2023 with English translation (13 pages).

International Search Report (PCT/ISA/210) issued in PCT Application No. PCT/EP2020/073303 dated Feb. 11, 2021 with English translation (eight (8) pages).

German-language Written Opinion (PCT/ISA/237) issued in PCT Application No. PCT/EP2020/073303 dated Feb. 11, 2021 (nine (9) pages).

English translation of Korean-language Office Action issued in Korean Application No. 10-2022-7008076 dated Sep. 10, 2024 (5 pages).

* cited by examiner

METHOD FOR OPERATING A WORKING MACHINE, AND WORKING MACHINE

BACKGROUND AND SUMMARY

The invention relates to a method for operating a working machine, and to a working machine.

The invention is based on the problem of providing a method for operating a working machine, and a working machine, which allow the working machine to be operated in the most optimal way possible.

The method is used for operating a working machine. The working machine has a device for conveying thick stock, for example in the form of liquid concrete. The working machine may be a truck-mounted concrete pump, for example.

When operating the working machine, a number of target values which control the operation of the device for conveying thick stock can be adjusted by a user.

The method comprises the following steps.

Collection of a number of actual values of the device, calculation of a target-value optimum for a respective target value of the number of adjustable target values based on the actual values detected, and issuing of an instruction to the user, in the event that an adjusted target value of the number of adjustable target values does not correspond to its calculated target-value optimum.

According to one embodiment, the number of adjustable target values selected from the quantity: target delivery quantity or target volume flow of the thick stock, target speed of a motor, in particular in the form of an electric motor or an internal combustion engine, which drives the device for delivering thick stock, and target position of a boom of the working machine. The target position of the boom may, for example, define a desired rotating angle position of the boom and/or desired angular positions between boom segments of the boom.

According to one embodiment, the number of actual values is selected from the quantity: actual hydraulic pressure of a hydraulic drive of the working machine, actual speed of a motor, in particular in the form of an electric motor or an internal combustion engine, which drives the device for delivering thick stock, actual position of a boom of the working machine, state of the thick stock, actual volume flow of a hydraulic drive of the working machine, actual vibrations of a substructure of the working machine, and actual delivery pressure of the thick stock.

According to one embodiment, the target-value optimum for a respective target value of the number of adjustable target values is calculated with the help of at least one optimizing criterion selected from the quantity: energy consumption, in particular fuel consumption, efficiency, boom vibrations, component stress, substructure vibrations, noise emissions.

According to one embodiment, the issuing of the instruction to the user involves the target-value optimum for a respective target value of the number of adjustable target values being displayed, and/or an associated adjusting device for adjusting a respective target value of the number of target values being shown highlighted, and/or a score being displayed which indicates the extent to which a respective target value of the number of adjustable target values corresponds to its associated optimum.

The working machine has a device for delivering thick stock, wherein the working machine is designed to carry out a method described above.

According to one embodiment, the working machine has a boom, in particular a boom with multiple boom segments connected to one another by means of articulations, wherein angular positions between the boom segments are adjustable by means of hydraulic cylinders.

According to one embodiment, the working machine has a hydraulic drive, in particular for driving the hydraulic cylinders associated with the boom segments.

The invention is described in detail below with reference to the drawings.

DETAILED DESCRIPTION OF THE DRAWINGS

Figure 1:
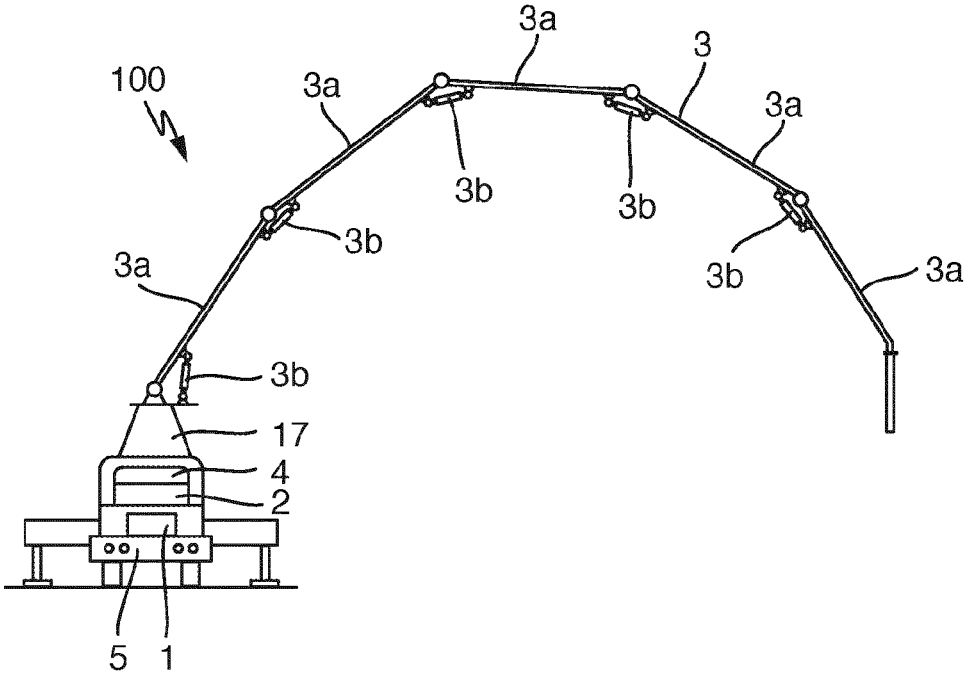
FIG. 1 shows schematically a working machine having a device for delivering thick stock.

FIG. 1 shows schematically a working machine 100 in the form of a truck-mounted concrete pump with a device 1 for delivering thick stock in the form of liquid concrete, an internal combustion engine 2, a boom 3 with a number of boom segments 3*a*, a hydraulic drive 4 operated by means of the internal combustion engine 2, and a substructure 5. The boom segments 3*a* of the boom are connected to one another by articulations, wherein angular positions between the boom segments 3*a* are adjustable by means of hydraulic cylinders 3*b*. The working machine 100 naturally has further traditional components, which are necessary in order to operate the working machine 100, but are not essential to the description of the invention. In particular, reference should therefore be made to the relevant literature, in particular to truck-mounted concrete pumps.

The internal combustion engine 2 may, of course, also be replaced by an electric motor.

Figure 2:
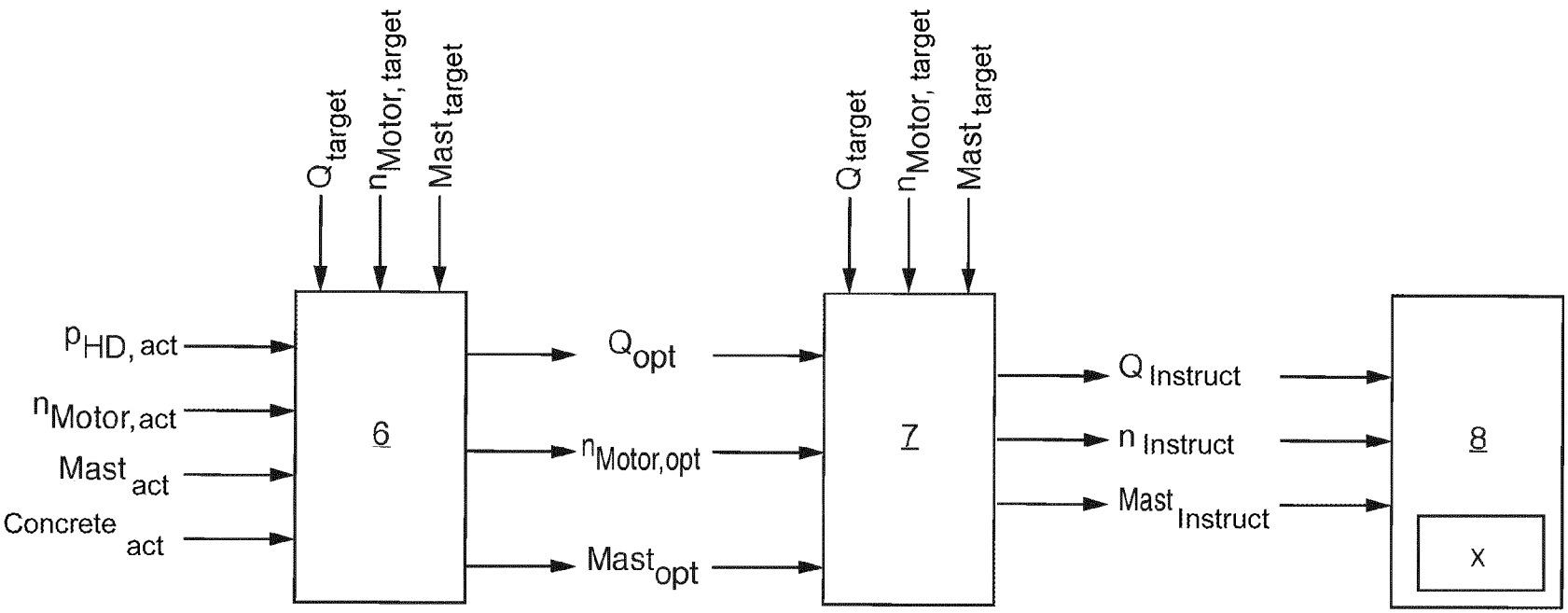
FIG. 2 is a block diagram relating to a calculation of target-value optimums and associated instructions to a user of the working machine shown in FIG. 1.

The operation of the working machine 100 is described below with reference to FIG. 2.

A number of actual values of the device 1 is collected and provided as input parameters to an optimum calculator 6. The actual values are exemplary: actual hydraulic pressure $p_{HD.act}$ of the hydraulic drive 4, actual speed $n_{engine.act}$ of the internal combustion engine 2, actual $boom_{act}$ position of the boom 3 and a $concrete_{act}$ state of the thick stock. The boom position may, for example, refer to a rotating angle position of the mast 3 and/or to angular positions between the mast segments 3*a*. The state of the $concrete_{act}$ of the thick stock may, for example, denote a viscosity, a moisture content, a density, etc. of the thick stock.

Furthermore, the optimum calculator 6 is provided with a number of user-adjustable target values as further input parameters. The user-adjustable target values are selected from the quantity: target delivery quantity or target volume flow $Q_{target}$ of the thick stock, target speed $n_{engine.target}$ of the internal combustion engine 2, and target position $boom_{target}$ of the boom 3.

With the help of one or multiple optimization criteria, the optimum calculator 6 uses the aforementioned input parameters to calculate associated target-value optimums or optimal values $Q_{opt}$ for the target delivery quantity or the target volume flow of the thick matter, $n_{engine.opt}$ for the target speed of the internal combustion engine 2, and $boom_{opt}$ for the target position of the mast 3.

The optimal values $Q_{opt}$ for the target delivery quantity or the target volume flow of the thick stock, $n_{engine.opt}$ for the target speed of the internal combustion engine 2 and $boom_{opt}$ for the target position of the boom 3 are entered in an instruction calculator 7, in addition to the user-adjusted target values $Q_{target}$ for the target delivery quantity or the target volume flow, $n_{engine.target}$ for the target speed, and $boom_{target}$ for the target position, which instruction calculator calculates associated instructions $Q_{instruction}$ for the target delivery quantity or the target volume flow of the thick matter, $n_{instruction}$ for the target speed of the internal combustion engine 2, and $boom_{instruction}$ for the target position of the boom 3, and issues them to a user, so that said user is able to perform an optimized adjustment of the target values on this basis of these.

The issuing of the instruction to the user may, for example, involve the target-value optimum for a respective target value of the number of adjustable target values being displayed, and/or an associated adjusting device for adjusting a respective target value of the number of target values being shown highlighted, and/or a score being displayed, which indicates the extent to which a respective target value of the number of target values corresponds to its associated optimum.

A score x may, for example, be graphically presented in a display 8. An exemplary calculation of the score x is described further on.

The at least one optimization criterion can be selected from the quantity: energy consumption or fuel consumption, efficiency, boom vibrations, component stress, substructure vibrations, noise emissions.

A mode M used for calculating a score x can be defined as follows, for example:

Active mode definition: $n_{engine.actual} \leq n_{engine.opt}$ AND hydraulic pump On Inactive mode definition: $n_{engine.actual} > n_{engine.opt}$ AND hydraulic pump On Off mode definition: Hydraulic pump Off The score x, an associated color display, and an associated symbol can then be calculated/determined as follows, for example, wherein by way of example, a constant a=50% (relative to a maximum delivery quantity) and a constant b=90% (relative to the maximum delivery quantity) are selected.

Case 1:

Active mode, actual delivery quantity $Q_{act}<a$, x=100, color displayed positive, ECO active symbol displayed, formula $x(M=\text{active}, Q_{act}<\alpha)=100$.

Case 2:

Active mode, $a<Q_{act<b}$, $50<x<100$, color displayed positive, reduce delivery quantity symbol displayed, $$\text{formula } x(M = \text{active}, a < Q_{act} < b) = -\frac{50}{b-a} * Q_{act} + \frac{100b - 50a}{b-a}$$

Case 3:

Active mode, $Q_{act}>b$, x=50, color displayed positive, reduce delivery quantity symbol displayed, formula $x(M=\text{active}, Q_{act}>b)=50$ Case 4:

Inactive mode, $0<x=75$, color displayed negative, activate ECO mode symbol displayed, $$\text{formula } x(M = \text{inactive}) = \frac{n_{engine.max} - n_{engine.act}}{n_{engine.max} - n_{engine.opt}} * (-0,5Q_{act} + 75),$$

wherein $n_{engine.max}$ represents a maximum engine speed.

Case 5:

Off mode, x=0, color displayed neutral, no symbol displayed, formula $x(M=\text{Off})=0$ A resettable long-term score S may be calculated as follows, for example.

Case 1:

Off mode, no calculation, display last value.

Case 2:

Active/Inactive mode, simultaneous mean value, $$S(t) = \frac{S(t-\Delta t) * (t_{reference} - \Delta t) + x(t) * \Delta t}{t_{reference}}$$

Case 3:

Reset mode, simultaneous mean value, S(0)=50; $t_{reference}=t_{pump,total}$ wherein $t_{pump,total}$ refers to the current pump operating hours. The reference time $t_{reference}$ for the long-term score S is then determined from $t_{reference}=t_{pump,total}-t_{pump,reset}$ Traditionally, a user of the working machine 100 has had to adjust a certain number of target values requiring adjustment themselves (free parameters/target variables), since the working machine 100 cannot judge for itself whether these target values are actually necessary for a working function or not. On the other hand, the user lacks the knowledge and information to decide whether setting these target values differently could lead to an improvement in machine function. The invention assists the user in finding a better setting for the target values.

According to the invention, based on current actual values and target values, an instruction is issued on how the user should set the freely adjustable target values, in order to satisfy a particular optimization criterion. The actual values may be, for example: hydraulic pressure $p_{HD,act}$, engine speed $n_{engine}$, boom position, concrete state, etc. The freely adjustable target values may be: delivery quantity $Q_{target}$, engine speed, boom position, etc. The optimization criteria may be: fuel consumption, boom vibrations, component stress (e.g. due to pump surges), etc.

The instruction may be determined based on, for example: online calculation, characteristic diagram/table from offline calculation, empirical characteristic diagram/table, limit values/threshold values, fuzzy logic, etc.

The determination may be discrete or continuous, and also based on real-time data or a data history. Calculated optimal values can be used in determining the instruction.

The instruction may, for example, be issued through: a direct display of the target-value optimums, a display for the actuation direction of the target values which have not been optimally set (for example, speed reduction without target value), display of the current situation (for example, yes/no optimum, calculated score), by means of a long-term score (inclusion of older data), etc.

By analyzing the current hydraulic pressure and the current engine speed, and also the target delivery quantity and the target engine speed (manually adjusted), for example, the optimal control of the hydraulic pumps and the optimal engine speed in relation to fuel consumption can be determined. If, for example, a large delivery quantity or an engine speed that differs from the optimum is set by the user, the instruction to set the optimal (or simply better) target values can be given to the user.

The invention claimed is:

1. A method for operating a working machine having a device for conveying thick stock, wherein a number of target values which relate to the operation of the device for conveying thick stock are adjustable by a user, the method comprising the steps of:

collecting a number of actual values of the device;

calculating a target-value optimum for a respective target value of the number of adjustable target values based on the number of actual values detected; and issuing an instruction to the user, in an event that an adjusted target value of the number of adjustable target values does not correspond to its calculated target-value optimum.

2. The method as claimed in claim 1, wherein the number of adjustable target values is selected from the quantity:

target delivery quantity of the thick stock, target speed of an engine which drives the device for delivering thick stock, and target position of a boom of the working machine.

3. The method as claimed in claim 2, wherein the number of actual values is selected from the quantity:

actual hydraulic pressure of a hydraulic drive of the working machine, actual speed of the engine which drives the device for delivering thick stock, actual position of the boom of the working machine, state of the thick stock, actual volume flow of the hydraulic drive of the working machine, actual vibrations of the boom of the working machine, actual vibrations of a substructure of the working machine, and actual delivery pressure of the thick stock.

4. The method as claimed in claim 1, wherein the number of actual values is selected from the quantity:

actual hydraulic pressure of a hydraulic drive of the working machine, actual speed of the engine which drives the device for delivering thick stock, actual position of the boom of the working machine, state of the thick stock, actual volume flow of the hydraulic drive of the working machine, actual vibrations of the boom of the working machine, actual vibrations of a substructure of the working machine, and actual delivery pressure of the thick stock.

5. The method as claimed in claim 1, wherein the target-value optimum for a respective target value of the number of adjustable target values is calculated as a function of at least one optimizing criterion selected from the quantity:

energy consumption and/or efficiency of an engine which drives the device for delivering thick stock, boom vibrations, component stress, substructure vibrations, and noise emissions.

6. The method as claimed in claim 5, wherein the energy consumption is a fuel consumption of an internal combustion engine which drives the device for delivering the thick stock.

7. The method as claimed in claim 1, wherein issuing of the instruction to the user involves:

the target-value optimum for a respective target value of the number of adjustable target values being displayed, and/or an associated adjusting device for adjusting a respective target value of the number of target values being shown highlighted, and/or a score being displayed which indicates an extent to which a respective target value of the number of adjustable target values corresponds to its associated optimum.

8. A working machine comprising a device for delivering thick stock, wherein the working machine comprises a computing device operatively configured to:

collect a number of actual values of the device;

calculate a target-value optimum for a respective target value of the number of adjustable target values based on the number of actual values detected; and issue an instruction to the user, in an event that an adjusted target value of the number of adjustable target values does not correspond to its calculated target-value optimum.

9. The working machine as claimed in claim 8, wherein the working machine has an engine which drives the device for conveying thick stock.

10. The working machine as claimed in claim 9, wherein the working machine has a boom.

11. The working machine as claimed in claim 9, wherein the working machine has a hydraulic drive.

* * * * *